United States Patent [19]

Grim

[11] Patent Number: 4,755,828

[45] **Date of Patent: * Jul. 5, 1988**

[54] POLARIZED SIGNAL RECEIVER WAVEGUIDES AND PROBE

[76] Inventor: Fay Grim, 565 Newberg NE, Port Charlotte, Fla. 33952

[ * ] Notice: The portion of the term of this patent subsequent to Nov. 19, 2002 has been disclaimed.

[21] Appl. No.: 796,284

[22] Filed: Nov. 8, 1985

Related U.S. Application Data

[63] Continuation-in-part of Ser. No. 621,119, Jun. 15, 1984, Pat. No. 4,554,553.

[51] Int. Cl.[4] ..... H01P 1/165

[52] U.S. Cl. ..... 343/786; 333/21 A

[58] Field of Search ..... 333/21 A, 21 R; 343/786, 840, 781 R

[56] References Cited

U.S. PATENT DOCUMENTS

| | | | |
|---|---|---|---|
| 2,880,399 | 3/1959 | Murphy | 333/21 R X |
| 3,553,707 | 1/1971 | Yang et al. | 343/786 X |
| 3,924,205 | 12/1975 | Hansen et al. | 333/21 R X |
| 4,168,504 | 9/1979 | Davis | 343/786 |
| 4,414,516 | 11/1983 | Howard | 333/21 A |
| 4,504,836 | 3/1985 | Seavey | 343/786 X |
| 4,554,553 | 11/1985 | Grim | 333/21 A X |
| 4,574,258 | 3/1986 | Cloutier | 333/21 A |
| 4,578,681 | 3/1986 | Howard | 343/840 |

*Primary Examiner*—Eugene R. LaRoche

*Assistant Examiner*—Benny T. Lee

*Attorney, Agent, or Firm*—Gifford, Groh, VanOphem, Sheridan, Sprinkle and Dolgorukov

[57] ABSTRACT

A polarized signal receiver waveguide assembly, or feedhorn, for receiving a selected one of linearly polarized electromagnetic signals in one waveguide of circular cross-section and for launching or transmitting the selected signal into a second waveguide of rectangular cross-section, the axes of the waveguides being disposed at right angle. A probe comprising a signal receiver portion disposed in a plane perpendicular to the axis of the first waveguide and a launch or transmitter portion having its axis perpendicular to the axis of the second waveguide has its launch or transmitter portion mounted in a controllably rotatable dielectric rod, such that rotation of the rod causes rotation of the signal receiver portion for alignment with a selected one of the polarized signals. The transmission line between the probe signal receiver portion and launch or transmitter portion consists of a pair of bifurcated branches forming a rectangle disposed along the axis of the first waveguide. The two waveguides are cast as a single-piece. A scaler ring mounted around the circular waveguide is adjustable in position along the waveguide to improve performance, the set off of the leading edge of the scaler ring from the open end of the waveguide being a function of the focal length to diameter ratio of the disk at the focus of which the feedhorn is installed.

15 Claims, 2 Drawing Sheets

POLARIZED SIGNAL RECEIVER WAVEGUIDES AND PROBE

CROSS REFERENCE TO RELATED APPLICATION

The present application is a continuation-in-part of application Ser. No. 621,119, filed June 15, 1984 for a Polarized Signal Receiver Probe issued as U.S. Pat. No. 4,554,553 on Nov. 19, 1985.

BACKGROUND OF THE INVENTION

The present invention relates to polarized signal receiver waveguides in general, or so-called "feedhorns", as used in dish antennas for TVRO (television receive only) systems, and more particularly to a single-piece polarized signal receiving and signal transmitting waveguide.

The RF signals transmitted by communication satellite transponders consist of two linearly polarized signals, rotated 90° from each other. The linearly polarized signals reflected by the dish are received through the open end of a feedhorn, installed at the focus of the dish and comprising a waveguide of circular cross section. Only one of the two polarized signals is received, the other signal being reflected out of the feedhorn. The detected signal is fed through a second waveguide, generally a waveguide having rectangular cross-section, whose axis is conventionally disposed at 90° to the axis of the feedhorn waveguide, and which feeds the detected signal to a low-noise amplifier (LNA).

Various antenna probe arrangements may be used for receiving one of the polarized signals in the feedhorn circular waveguide and for launching, or retransmitting the detected signal into the rectangular waveguide. Generally, the probe comprises a receiver portion disposed in the circular waveguide, and a signal launch or transmitter portion disposed in the rectangular waveguide, the probe being supported by a rotatable dielectric rod driven by a servomotor mounted on the waveguide assembly. The launch or transmitter portion of the probe has its axis aligned with the axis of the circular waveguide and with the axis of the dielectric rod, such as to remain constantly perpendicular to the axis of the rectangular waveguide during rotation of the probe. The probe receiver portion has its longitudinal axis perpendicular to the axis of rotation such as to rotate between the two orthogonally polarized signals in the circular waveguide. By rotation to a desired position, one polarized signal is received and the other is reflected. The received signal is conducted by the transmission line portion of the probe through the rear wall of the circular waveguide and is launched or retransmitted into the rectangular waveguide by the probe launch or transmitter portion.

The circular waveguide and the rectangular waveguide are conventionally made of separate elements, usually separate castings of, preferably, aluminum alloy. The two castings are assembled together, usually by providing one of the waveguides, for example the rectangular waveguide, with a flange which is bolted to the rear end of the circular waveguide, the rectangular waveguide being provided with a circular recess in which projects a correspondingly cylindrical end portion of the circular waveguide. Such an assembly is relatively fragile, causes power losses and the introduction of noise in the signal received in the circular waveguide and launched or retransmitted in the rectangular waveguide.

As the waveguide assembly is installed in an outdoor TVRO dish antenna, the assembly is exposed to inclement weather, such as rain or snow, dust and high wind, and to atmospheric pollution, all adverse conditions that may cause rapid deterioration, corrosion of the metallic surfaces and loosening of the joint between the waveguides. There results further deterioration of the relatively low level ultra-high frequency signals captured by the antenna system.

The present invention is an improvement upon the prior art polarized signal feedhorn waveguides and probes.

SUMMARY OF THE INVENTION

The present invention provides a microwave polarized signal receiver and transmission system in the form of a single-piece waveguide structure having a rotatable probe for receiving an appropriate one of two linearly polarized signals, fed into a first waveguide, and for transmitting the selected one of the signals to a second waveguide disposed perpendicularly to and cast integral with the first waveguide, and for launching or retransmitting the selected signal in the second waveguide. The present invention, due to its particular waveguide and receiver probe structure, provides substantial improvement in amplitude of the signal, reduction of parasitical capacitance during transfer of signals from one waveguide to another, and greatly improves the signal-to-noise ratio and the rejection of unwanted signals, as compared to polarized signal receiver, transmission and launch systems heretofore available.

A better understanding of the present invention and of its many objects and advantages will be obtained by those skilled in the art from the following description of the best mode contemplated for practicing the invention, when read in conjunction with the accompanying drawing wherein:

DETAILED DESCRIPTION OF THE PREFERRED EMBODIMENTS

Figure 1:
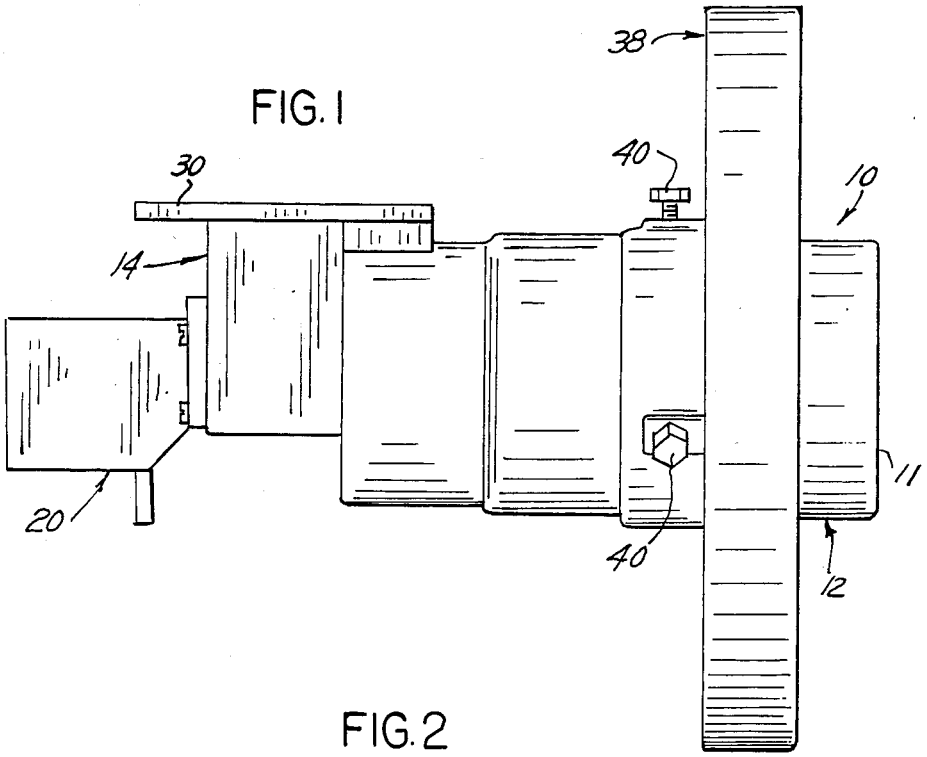
FIG. 1 is a side elevation view of a waveguide assembly according to the invention.
Figure 2:
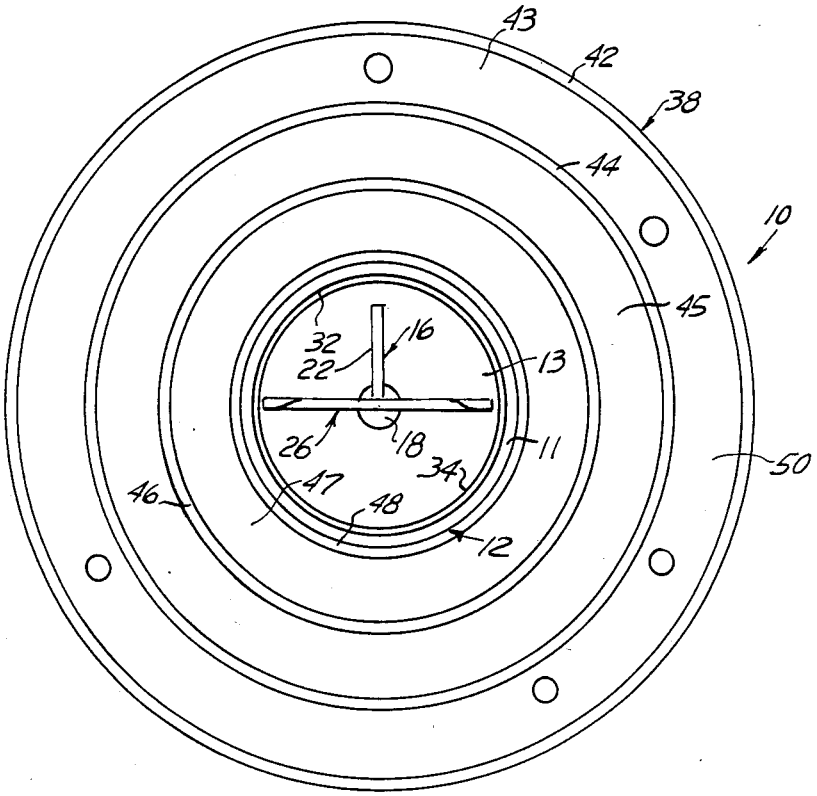
FIG. 2 is a front elevation view thereof.
Figure 3:
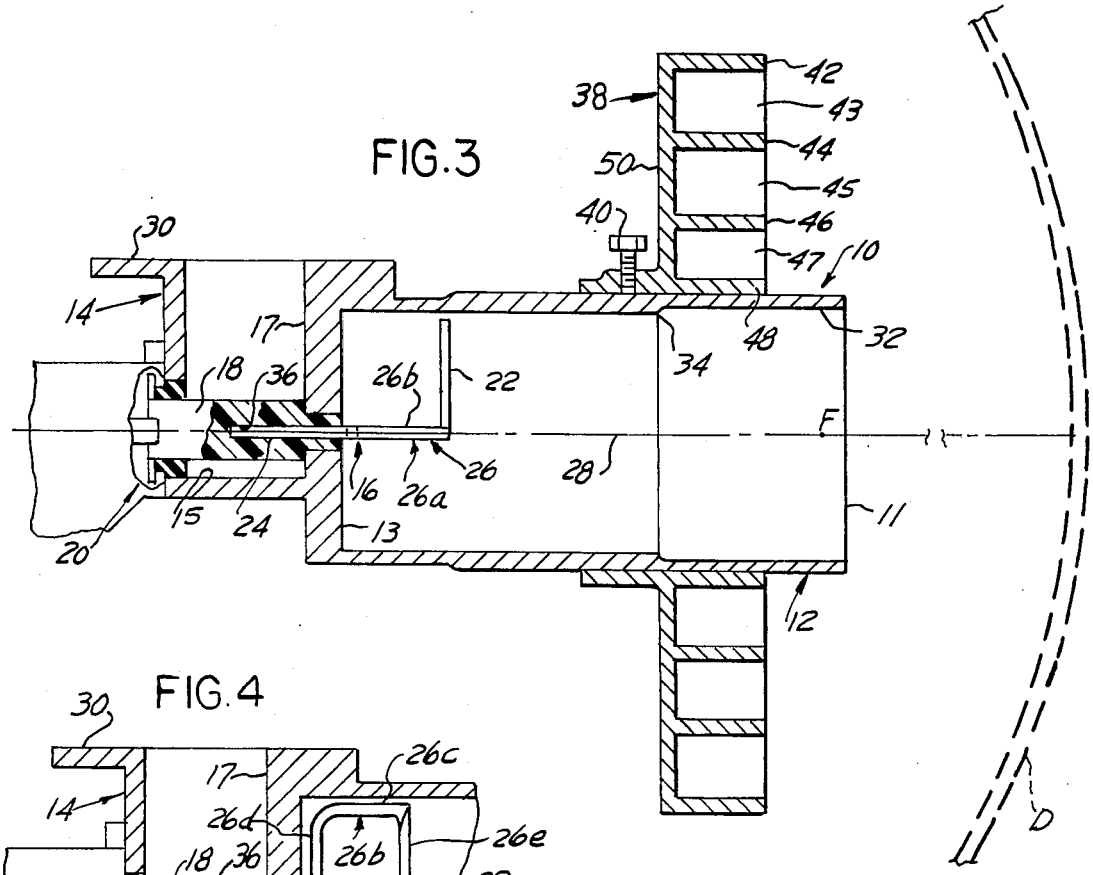
FIG. 3 is a longitudinal sectional view thereof along line 3—3 of FIG. 2.

Referring now to the drawing, and more particularly to FIGS. 1–3, there is illustrated a feedhorn 10 for reception of satellite transmitted television signals or other RF signals of ultra-high frequency, for example in the 3.7 to 4.2 GHz range, as presently used. The feedhorn 10 is generally used installed at the focus of a parabolic reflector dish, shown schematically at D at FIG. 3, such that the RF microwaves are reflected into the open end 11 of the feedhorn 10.

The feedhorn 10 is made principally of a pair of waveguides 12 and 14, cast integrally of metal or metal alloy such as, for example, aluminum alloy. The waveguide 12 is a circular waveguide, i.e. circular in cross-section, while the waveguide 14 is a rectangular waveguide, i.e. rectangular in cross-section.

The circular waveguide 12 has an integral rear wall 13 and is disposed with its longitudinal axis at right angle to the longitudinal axis of the retangular waveguide 14 formed integrally at the closed end, or rear wall, 13 of the circular waveguide 12. The rectangular waveguide 14 is closed at one end by an end or rear wall 15 and is coupled at its open end to a low-noise signal amplifier (LNA), not shown. A probe 16 is fixedly mounted coaxially in a dielectric rod or shaft 18 disposed rotatable through the rearwall 13 of the circular waveguide 12 which is integral with a corresponding sidewall 17 of the rectangular waveguide 14. The dielectric rod or shaft 18 and the probe 16 are driven in rotation by a servomotor 20.

The probe 16 is made of a single continuous electrical conductor and, preferably, of a single-piece precision casting or stamping of electrically conductive metal or alloy. The probe 16 comprises a receiver portion 22, approximately one-quarter wavelength long, having its longitudinal axis disposed in a plane perpendicular to the longitudinal axis of the circular waveguide 12, and a signal launch, or transmitter, portion 24 held within the dielectric rod 18 with its longitudinal axis aligned with the longitudinal axis, or axis of symmetry, 28 of the circular waveguide 12. The probe signal launch or transmitter portion 24 projects within the rectangular waveguide 14, perpendicularly to the longitudinal axis of the waveguide 14. The probe signal receiver portion 22 and signal launch or transmitter portion 24 are integrally connected by a transmission line portion 26. The transmission line portion 26 is substantially a rectangle disposed in a plane aligned with the longitudinal axis of the probe signal launch or transmitter portion 24, and perpendicular to the longitudinal axis of the probe signal receiver portion 22.

Figure 4:
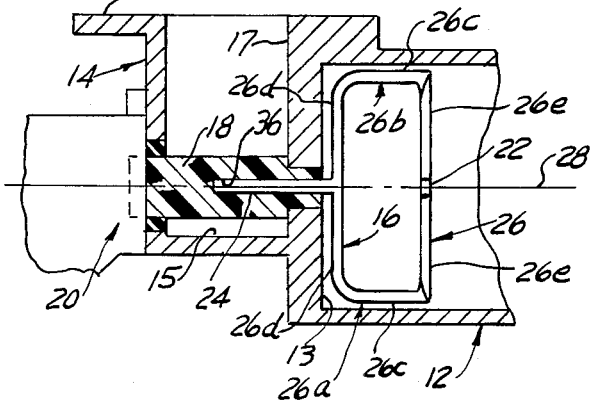
FIG. 4 is a partial view similar to FIG. 3 but showing the receiver probe rotated 90° from the position shown at FIG. 3.
Figure 5:
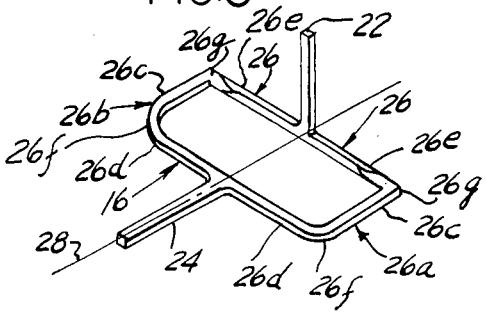
FIG. 5 is a perspective view of the probe portion thereof.

As best shown at FIGS. 4 and 5, the transmission line portion 26 is formed of two U-shaped branches 26*a* and 26*b*, respectively, which are equal in length relative to an axis of symmetry. The axis of symmetry coincides with the longitudinal axis 28 of the circular waveguide 12 and with the axis of rotation of the probe 16. Equality of the lengths of the transmission line branches 26*a* and 26*b* is critical for minimizing signal strength losses between the probe signal receiver portion 22 and the probe signal launch or transmitter portion 24. Accurate fabrication of the probe 16, such as by precision casting or stamping, results in providing equal length branches 26*a* and 26*b* for the transmission line 26, and in providing accurate one-quarter wavelength for the probe signal receiver portion 22, for better rejection of unwanted signals, and improved signal-to-noise ratio performance.

Figure 6:
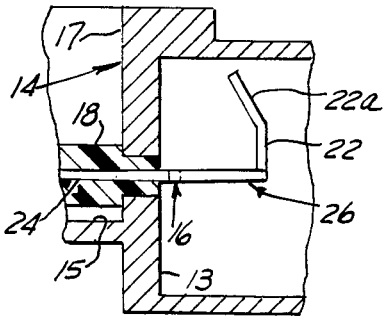
FIGS. 6 and 7 are partial views similar to FIG. 3 but showing modifications of the probe portion thereof.
Figure 7:
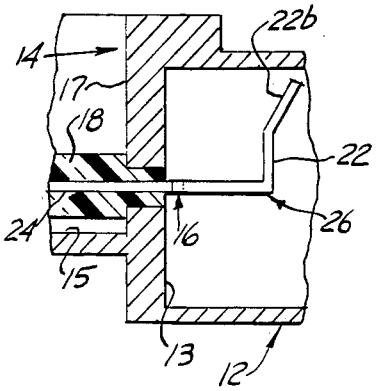

It has been found experimentally that improved performance is achieved by providing arcuate corners, shown at 26*f* at FIG. 5, at the integral junctions between the branches 26*d* and 26*c* of the transmission line 26, while the integral junction between the branches 26*c* and 26*e* may remain sharp, as shown at 26*g*. Typically, the probe 16 is economically made of an aluminum alloy stamping, with the probe signal receiver portion 22 originally disposed in the same plane as that of the transmission line 26 and subsequently bent over by twisting the branches 26*e* for disposing the probe signal receiver portion 22 substantially at a right angle to the plane of the transmission line 26. Although, in most installations, the probe signal receiver portion 22 is disposed at such right angle to the plane of the transmission line 26, it may be bent at an angle other than 90° to the plane of the transmission line 26, for favoring reception of RF microwave signals in the upper or lower portion of the frequency range. However, a preferred arrangement for tuning the probe 16 for improving reception at the lower or higher portion of a given frequency range consists in bending the probe signal receiver portion 22 at approximately one half of its length, backward, as shown at 22*a* at FIG. 6 for improving reception of high-frequency signals, with its tip directed towards the circular waveguide rear wall 13, or bending the probe receiver portion 22, as shown at 22*b* at FIG. 7, forward away from the rear wall 13, for improving the reception of lower frequency signals, within a given frequency range.

The particular configuration of the probe transmission line 26 between the probe signal receiver portion 22 and signal launch or transmitter portion 24 results in a practically capacitanceless transmission line, and in good impedance match between the two integral waveguides 12 and 14. The length of the portion 26*c* of each branch, parallel to the axis 28 of the circular waveguide 12, is preferably one-quarter of a wavelength. The length of the portions 26*d* and 26*e* is also preferably approximately one-quarter of a wavelength. The portions 26*d* are parallel to the rear wall 13 of the waveguide 12, and about 2 to 4 mm. away from the surface of the rear wall 13. The length of the probe launch or transmitter portion 24 is not critical, as long as the probe launch or transmitter portion 24 extends into the rectangular waveguide 14 beyond the end wall 13 of the circular waveguide 12. Typically, and only for the sake of convenience, the length of the launch probe portion 24 extending into the waveguide 14 is approximately 1/6 of the wavelength.

In operation, the probe 16, FIGS. 3–4, is rotatively driven, from a remote control location, by way of the servomotor 20 rotating the dielectric rod or shaft 18, thus causing the probe signal receiver portion 22 to sweep a substantially circular plane in the circular waveguide 12, perpendicular to the axis 28. As the probe signal receiver portion 22 aligns itself with the desired linearly polarized signal in the circular waveguide 12, the detected signal is transmitted through the bifurcated transmission line 26 to the probe signal launch or transmitter portion 24 projecting in the rectangular waveguide 14. The desired orientation of the probe signal receiver portion 22 is determined by a peak in the detected signal. The signal launched in the rectangular waveguide 14 by the probe signal launch or transmitter portion 24 is evidently unaffected by the rotation of the probe 16, because the probe signal launch or transmitter portion 24 rotates around the axis of symmetry 28 of the circular waveguide 12.

Referring back to FIGS. 1–3, it is clear that one aspect of the invention is to mold the circular waveguide 12 as a single-piece with rectangluar waveguide 14. The circular end wall 13 of the circular waveguide 12 integrally forms a portion of the sidewall 17 of the rectangular waveguide 14. There is no requirement to mechanically couple, by means of fasteners, the circular waveguide 12 and the rectangular waveguide 14, thus providing a single-piece feedhorn unit at a relatively low cost, as compared to a two-piece assembly.

The rectangular waveguide 14 is provided at its open end with a flange 30 for coupling to an appropriate input waveguide of the LNA. The circular waveguide 12 is provided at its open end 11 with an internally enlarged diameter portion 32 forming a shoulder 34 at the junction between the internal surface of the circular waveguide 12 and the internal surface of its enlarged diameter portion 32. The step or shoulder 34 acts as a reference shoulder for an appropriate depth gauge, not shown, for exact location, during assembly, of the probe 16 into the dielectric rod 18 for determining the longitudinal positioning of the probe receiver portion 22 in the circular waveguide 12. The probe 16 is attached to the dielectric rod of shaft 18 as a result of the probe launch or transmitter portion 24 being cemented in an axially disposed central bore 36, FIG. 3, in the dielectric rod 18.

Another aspect of the present invention is to provide the feedhorn 10 with an adjustable "scaler" ring 38 having a central aperture 48 for which may be longitudinally positioning in the most effective position along the circular waveguide 12 and held in position by tightening the set screws or bolts 40. As is known in the art, a scaler ring structure such as the illustrated structure provided with as plurality of concentric rings, 42, 44 and 46, forming concentric channels 43, 45 and 47 between the rings 42, 44, 46 and a bottom flat circular plate 50, produces out of phase coupling of the principal receiving aperture or open end 11 of the circular waveguide 12, as explained in detail, for example, in U.S. Pat. No. 4,168,504, for Multi-Mode Dual Frequency Antenna Feed Horn.

The longitudinal positioning of the scaler ring 38 is dependent upon the f/D ratio of the dish in which the feedhorn 10 is installed, f being the focal length of the dish and D the diameter of the dish. Normally, and for best performance, the feedhorn 10 is suspended over the center of the dish with the centerline of the dish coinciding with the centerline 28 of the circular waveguide 12. The focal point 7 of the dish is situated within the circular waveguide 12, 6.5 mm from the edge of the waveguide open end 11. For a dish having an f/D ratio of 0.42 the leading edge of the scaler ring 38 is positioned flush with the leading edge of the circular waveguide 12. The scaler ring offset distance from the leading edge of the circular waveguide 12 as a function of the dish f/D ratio is a linear function, such that for a dish f/D ratio of 0.4, the offset is 5 mm, for a dish f/D ratio of 0.38 the offset is 10 mm, for a f/D ratio of 0.36, the offset is 25 mm, etc. The numerical example hereinbefore given are particularly suitable for operation in the frequency range of 3.7–4.2 GHz, conventionally in use at the present, and for the future K-band at which projected TVRO systems will operate.

Having thus described the present invention by way of examples of structure well designed for accomplishing the objects of the invention, modifications whereof will be apparent to those skilled in the art, what is claimed as new is as follows:

I claim:

1. A polarized signal receiver comprising a first waveguide of circular cross-section for receiving polarized electromagnetic signals applied to an open end thereof, said first waveguide having an axis of symmetry and another end closed by a rear wall, a second waveguide for transmitting polarized signals, said second waveguide having an axis of symmetry and said first and second waveguides being disposed with their axes of symmetry at a substantially 90° angle, a dielectric rod mounted through the rear wall of said first waveguide, said dielectric rod being rotatable around an axis of rotation aligned with the axis of symmetry of said first waveguide, a signal transferring probe fixedly mounted in said dielectric rod for rotation thereby about the axis of rotation thereof, said signal transferring probe comprising a receiver portion for receiving one of the polarized signals in said first waveguide, a launch or transmitter portion extending into the second waveguide substantially perpendicular to the axis of symmetry of said second waveguide, said launch or transmitter portion being disposed concentrically within said dielectric rod, and a transmission line portion connecting said receiver portion to said launch or transmitter portion, said transmission line portion having two integral oppositely directed and symmetrical generally U-shaped branch portions forming a rectangle disposed in said first waveguide in a single plane along the axis of symmetry of said first waveguide and perpendicular to the plane in which said probe receiver portion is disposed, and means for controllably rotating said dielectric rod and said signal transferring probe for transferring a selected one of said polarized signals from said first waveguide to said second waveguide at a peak of signal amplitude in said second waveguide, wherein said probe receiver portion has a first section integrally connected to said transmission line portion and disposed in a plane orthogonal to the axis of symmetry of said first waveguide and a tip section extending from said first section along a plane extending through said axis of symmetry of said first waveguide and angled with respect to said rear wall.

2. The improvement of claim 1 further comprising a scaler ring having a central aperture for slidably receiving said first waveguide within said aperutre, said scaler ring having a circular flat plate extending on a plane normal to said axis of first waveguide, said flat plate having a plurality of integral concentric rings defining therebetween a plurality of concentric channels, said scaler ring being longitudinally slidable along said first waveguide for adjusting the position thereof longitudinally along said first waveguide, and means for clamping said scaler ring in a set position.

3. The improvement of claim 2 wherein said scaler ring is offset from the open end of said first waveguide by a distance which is a function of the focal length to diameter ratio of a reflector dish in which said feedhorn is installed.

4. The polarized signal receiver of claim 1 wherein said tip section of said probe receiver portion extends from said first section in a direction angled away from said rear wall of said first waveguide.

5. The polarized signal receiver of claim 4 wherein said signal transferring probe is a single-piece metallic stamping.

6. The polarized signal receiver of claim 5 wherein the rectangle formed by said probe transmission line portion has arcuate corners disposed proximate said first waveguide rear wall.

7. The polarized signal receiver of claim 1 wherein said tip section of said probe receiver portion extends from said first section in a direction angled towards said rear wall of said first waveguide.

8. The polarized signal receiver of claim 7 wherein said signal transferring probe is a single-piece metallic stamping.

9. The polarized signal receiver of claim 8 wherein the rectangle formed by said probe transmission line portion has arcuate corners disposed proximate said first waveguide rear wall.

10. The polarized signal receiver of claim 7 wherein the rectangle formed by said probe transmission line portion has arcuate corners disposed proximate said first waveguide rear wall.

11. The polarized signal receiver of claim 1 wherein said signal transferring probe is a single-piece metallic stamping.

12. The polarized signal receiver of claim 11 wherein the rectangle formed by said probe transmission line portion has arcuate corners disposed proximate said first waveguide rear wall.

13. The polarized signal receiver of claim 1 wherein said receiver portion of said probe is generally one-quarter wave length long.

14. The polarized signal receiver of claim 1 wherein said first section of said receiver portion of said probe is generally one-half the length of said probe receiver portion.

15. The polarized signal receiver of claim 1 wherein said tip section is generally one-half of the length of said receiver portion of said probe.

* * * * *